United States Patent [19]

Dixon et al.

[11] Patent Number: 4,894,026

[45] Date of Patent: Jan. 16, 1990

[54] MINIATURE CIRCULAR DIN CONNECTOR

[75] Inventors: Daniel A. Dixon; Hsin Lee, both of Naperville; Eugene J. Mysiak, Lisle; Henry Zielke, Hoffman Estates, all of Ill.

[73] Assignee: Molex Incorporated, Lisle, Ill.

[21] Appl. No.: 310,979

[22] Filed: Feb. 14, 1989

Related U.S. Application Data

[63] Continuation-in-part of Ser. No. 275,818, Nov. 25, 1988.

[51] Int. Cl.[4] ..... H01R 13/648

[52] U.S. Cl. ..... 439/609

[58] Field of Search ..... 439/607'610

[56] References Cited

U.S. PATENT DOCUMENTS

| | | | |
|---|---|---|---|
| 3,133,780 | 5/1964 | Dean | 439/857 |
| 3,808,578 | 4/1974 | Hansen | 439/595 |
| 4,156,553 | 5/1979 | Ammon et al. | 439/682 |
| 4,493,525 | 1/1985 | Hall et al. | 439/746 |
| 4,637,669 | 1/1987 | Tajima | 439/95 |
| 4,655,518 | 4/1987 | Johnson et al. | 439/609 |
| 4,772,224 | 9/1988 | Talend | 439/607 |

FOREIGN PATENT DOCUMENTS

| | | |
|---|---|---|
| 2733634 | 2/1979 | Fed. Rep. of Germany . |
| 1515850 | 7/1979 | Fed. Rep. of Germany . |

*Primary Examiner*—Gary F. Paumen

*Attorney, Agent, or Firm*—Louis A. Hecht; Stephen Z. Weiss

[57] ABSTRACT

A miniature DIN connector is provided for mounting to a circuit board. The miniature DIN connector comprises a molded nonconductive housing having a plurality of apertures therein for receiving electrically conductive terminals. The housing includes an array of channels for positively positioning the board contact portions extending from the terminals and preventing lateral movement thereof. An internal shield is mountable in the housing to substantially surround pin-receiving portions of the terminals. The housing is lockingly engageable with a base, which in turn is mountable to the circuit board. The base includes apertures through which the board contact portions of the terminals may be directed. An external shield is disposed around four sides of the miniature DIN connector and is groundable to the board. The internal and external shields are not connected to one another, however the external shield may include a contact for directly contacting the shield of a DIN connector plug.

19 Claims, 12 Drawing Sheets

MINIATURE CIRCULAR DIN CONNECTOR

CROSS REFERENCE TO RELATED APPLICATION

This application is a continuation-in-part of U.S. patent application Ser. No. 275,818 which was filed on Nov. 25, 1988 and which is assigned to the assignee of the subject application.

BACKGROUND OF THE INVENTION

Miniature circular DIN connectors are employed with computers, audio equipment, video equipment and other electrical components to enable the connection of one such component to another. Miniature circular DIN connectors comprise a plurality of pin or socket terminals which are mounted in a nonconductive housing and which are electrically connected to conductive leads. One such DIN connector may be mounted to a panel or circuit board of an electrical component, with the terminals of the DIN connector being electrically connected to conductive areas on the panel or circuit board. A mating DIN connector may then be mounted to a cable, with the terminals thereof being electrically connected to conductive wire leads within the cable. Typically, the board mounted miniature circular DIN connectors will define receptacles with pin-receiving terminals therein, while the cable mounted DIN connectors define plugs with pin terminals therein. The cable may include a second DIN connector plug on its opposed end for electrical mating to a miniature circular DIN connector in a related electrical component. In this manner, for example, the keyboard or mouse of a personal computer may be joined to the central processing unit thereof. The number and arrangement of pins or sockets in the miniature circular DIN connector can vary, with most DIN connectors having between three and nine terminals therein. The particular arrangement of terminals in the DIN connector and the construction of the housings are intended to ensure polarized mating of the respective terminals.

The board mounted miniature circular DIN receptacles will include terminals having solder tails, surface mountable contacts or other such contact means for making electrical connection to appropriate conductive portions of the circuit board. The very high circuit density on the board requires extremely accurate positioning of the board contact means of each terminal to ensure that the circuits are properly completed by the DIN connector. This accuracy becomes both more difficult and more important as the circuit density increases and as the DIN connector size decreases.

Government agencies maintain strict EMI standards to ensure that electromagnetic energy generated by cables and electrical equipment does not interfere with other electrical equipment or telecommunications equipment. The United States Federal Communications Commission maintains rigid standards to control the levels of EMI.

DIN connectors generally are considered to be a potential location on an electrical apparatus from which EMI may be emitted. As a result, most DIN connectors are provided with a shield to control EMI. The shield typically will comprise an annular metallic member that surrounds the terminals and is grounded to the board. The grounded shielding is intended to prevent or control the dissipation of electromagnetic energy.

The circuit density in virtually all electrical components has dramatically increased in recent years due to a general reduction in the size of the components and/or an increase in the complexity of the circuitry. The greater circuit density has required correspondingly smaller electrical connectors of all sorts, including the miniature circular DIN connectors. Furthermore, the increased circuit density in the vicinity of electrical connectors has substantially reduced the options available for achieving certain functions, such as controlling EMI. Additionally, the smaller electrical connectors required by the increased circuit densities have made it extremely difficult to provide socket terminals that can exert acceptable contact pressure while simultaneously exhibiting adequate resiliency after several connections and reconnections. In this regard, it should be realized that miniature circular DIN connectors used in currently marketed computers may define a cube of only approximately 0.50 inch square (e.g., about 1.25 cm) within which 3–9 terminals and the necessary EMI shields are disposed. The 3–9 terminals within this 0.50 inch (1.25 cm) square DIN connector may be required to exert normal mating contact forces of between 50–100 grams per contact, and may be required to perform satisfactorily after repeated mating and unmating operations.

An extremely effective miniature terminal that can be incorporated into a miniature circular DIN connector is disclosed in co-pending patent application Ser. No. 255,001 which was filed on Oct. 6, 1988, by Dominique Bertho et al and which is entitled "ELASTICALLY SUPPORTED DUAL CANTILEVER BEAM PIN-RECEIVING ELECTRICAL CONTACT". Co-pending application Ser. No. 255,001 is assigned to the assignee of the subject invention, and the disclosure thereof is incorporated herein by reference. Co-pending patent application Ser. No. 255,001 does not specifically address structures for dealing with EMI in miniature DIN connectors. Similarly, co-pending application Ser. No. 255,001 does not address the difficulties associated with the secure and accurate disposition of terminals in a DIN connector.

The prior art does include attempts to provide EMI shielding for DIN connectors. For example, U.S. Pat. No. 4,493,525 which issued to Hall et al on Jan. 15, 1985 shows a DIN receptacle having an annular groove with a communicating recess which is adapted to receive a grounding spring for contacting the mating shield on a plug. No outer shield for the connector housing is provided in U.S. Pat. No. 4,493,525. However, in certain embodiments, a front shield extends entirely across the front face of the connector. Structures very similar to those shown in certain embodiments of U.S. Pat. No. 4,493,525 are also shown in German Patent Publication No. 1,515,850 which was published on Jan. 2, 1970 and in German Patent Publication No. 2,733,634 which was published on Feb. 8, 1979.

Another DIN connector which employs an EMI shield is shown in U.S. Pat. No. 4,637,669 which issued to Tajima on Jan. 20, 1987. The connector of U.S. Pat. No. 4,637,669 includes a base which is mountable to a circuit board, panel or the like and a housing which is mountable to the base. The housing is constructed to loosely receive a plurality of conductive terminals at central locations therein, and is further provided with means for receiving an annular shield around portions of the housing in which the terminals are mounted. The DIN connector shown in U.S. Pat. No. 4,637,669 further includes an external shield which is electrically and mechanically connected to the annular internal shield of the connector. The external shield is constructed to extend across the top of the DIN connector housing, down two opposed side walls of the housing and into proximity to the circuit board. The three-sided external shield of U.S. Pat. No. 4,637,669 and the annular internal shield connected thereto are intended to function as a single effective EMI shield.

Many DIN connectors with EMI shielding are constructed to provide the shield for EMI generated at the cable/DIN interface. It has now been found, however, that in many applications a greater amount of EMI is generated from the computer or other such electrical component to which the DIN connector is mounted. In many such situations, the EMI shield intended to shield the cable/DIN connector interface will actually function as an antenna that will generate rather than suppress the greater levels of EMI generated from the electrical component to which the DIN connector is mounted. In some situations, for example, the interconnection of internal and external EMI shields will create a loop that may function as an antenna.

In view of the above, it is an object of the subject invention to provide a miniature circular DIN connector having enhanced EMI shielding.

It is another object of the subject invention to provide a miniature circular DIN connector that is effective in shielding EMI generated by both the cable/ connector interface and by the electrical component to which the DIN connector is mounted.

It is an additional object of the subject invention to provide a miniature circular DIN connector where the EMI shield does not function as an antenna that would radiate certain types of EMI..

A further object of the subject invention is to provide a miniature circular DIN connector that can be manufactured in a very small size while still providing acceptable contact forces and an ability to repeatedly connect and disconnect.

Still another object of the subject invention is to provide a miniature circular DIN connector which accurately positions the board contact means of the terminals therein.

Yet another object of the subject invention is to provide an external shield for a miniature circular DIN connector that provides a substantially maximum external surface area.

Another object of the subject invention is to provide direct electrical connection between the external shield of the miniature circular DIN connector and the shield of a mateable DIN connector plug.

SUMMARY OF THE INVENTION

The subject invention is directed to a miniature circular DIN connector receptacle which may comprise a mating face for mating to a DIN connector plug and a board mounting face for mounting to a circuit board, panel or the like. The miniature DIN connector may define a generally rectilinear structure which comprises a nonconductive molded housing having a plurality of terminals mounted therein. The terminals mounted in the housing of the miniature DIN connector may comprise pin-receiving contact portions which are constructed to mate with corresponding pins on a DIN plug. In particular, the terminals may be elastically supported dual cantilever beam pin-receiving terminals as disclosed in co-pending application Ser. No. 225,001, and as described and illustrated further herein. Each terminal may comprise board contact means, such as solder tails, for extending to conductive portions of the circuit board. The housing may comprise channel means for positively positioning the board contact means of each respective terminal. The housing may further be constructed to permit connection between the external shield and the shield of the DIN connector plug.

An annular conductive EMI shield may be mounted in the housing to extend from the mating face of the connector and substantially surround the pin-receiving contact portions of the terminals therein. The annular internal EMI shield is constructed for electrically contacting a corresponding shield on a DIN plug to be mated with the subject miniature circular DIN connector. The annular internal shield may comprise means for engaging the shield of the DIN connector plug and thereby increasing the forces required for disconnection or unmating. The annular internal EMI shield comprises contact means for grounding the annular internal shield to the board on which the subject miniature circular DIN connector is mountable. The annular internal shield may further be formed to permit direct electrical connection between the external shield and the shield of a mateable DIN connector plug.

The miniature circular DIN connector of the subject invention may further comprise a nonconductive base which is engageable with the housing. The base may comprise aperture means for receiving the board contact means of the respective terminals which are to be electrically connected to conductive areas on a circuit board. The aperture means in the base may cooperate with the channel means of the housing for positively and accurately positioning the board contact means of each terminal. For example, the base may comprise an array of apertures into which solder tails of the terminals may be inserted. The base may further comprise guide means for guiding the housing into a proper position to ensure alignment of the solder tails or other such board contact means of the terminals with the apertures in the base. In particular, the base may comprise a generally upstanding back wall against which portions of the housing may be slidably advanced. The base may also comprise resilient latch means for lockingly retaining the housing thereto. The latch means may comprise ramps which are operative to both guide the housing into proper alignment and to facilitate the deflection of the resilient latch means for subsequent locking engagement with the housing.

The miniature circular DIN connector further comprises an external EMI shield which may define the exterior surface for all of the DIN connector except the front mating face and the bottom board mounting face. In particular, the shield may be constructed to substantially cover the top, both opposed sides and the back of the miniature DIN connector. In this regard, the top of the miniature DIN connector is defined as the portion thereof opposite the board to which the miniature DIN connector is mounted. The back is defined as the portion thereof opposite the mating face of the miniature DIN connector into which a mating DIN plug connector is received. The opposed sides, therefore, extend substantially continuously between the front and back faces of the miniature DIN connector. Thus, the external shield defines a substantially maximum external surface area. The external shield of the subject miniature DIN connector may be formed from a unitary piece of metallic material. The external shield may include contact means for grounding the external shield to the board. Preferably, the external shield and the annular internal shield are grounded to the board separately, and are not electrically or mechanically connected to one another. It is believed the separation of the external shield and the annular internal shield by the nonconductive housing and base has been found to provide superior EMI shielding in many situations, and in particular, in those where a major portion of the electromagnetic radiation may be generated from the electrical component to which the DIN connector is mounted. Preferably the external shield is electrically connected to the shield of the DIN connector plug with which the subject miniature circular DIN connector is mated. In particular, the external shield may comprise deflectable connecting means which is disposed to be contacted by the shield of the DIN connector plug upon mating. The deflectable connecting means may be disposed to extend through apertures or slots in the housing and annular internal shield of the miniature circular DIN connector. The deflectable connecting means may comprise means for engaging the shield of the DIN connector plug to increase the forces required for disconnection or unmating.

DETAILED DESCRIPTION OF THE PREFERRED EMBODIMENT

Figure 1:
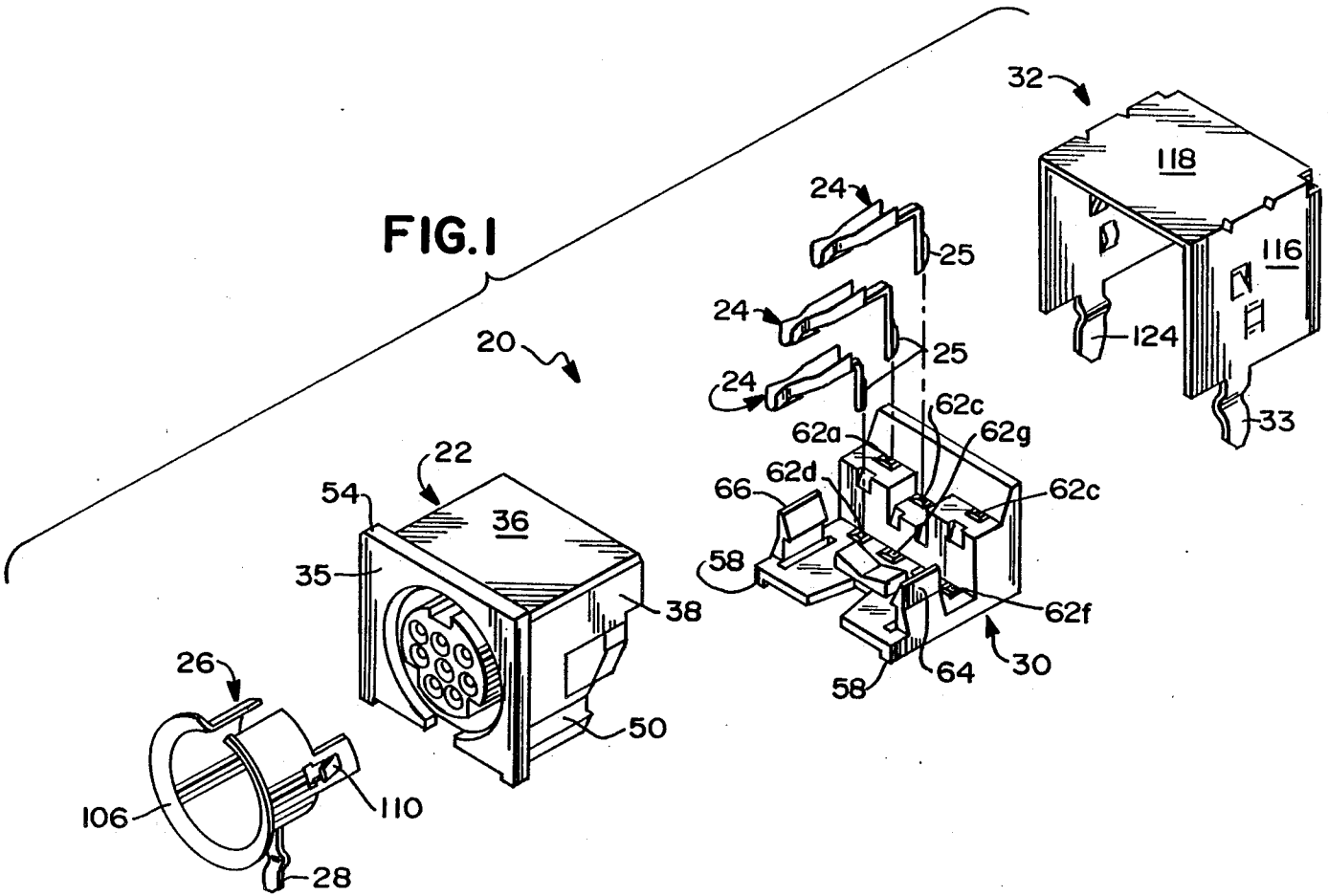
FIG. 1 is an exploded perspective view of the DIN connector of the subject invention.

The miniature circular DIN connector receptacle of the subject invention is identified generally by the numeral 20 in FIGS. 1 and 12–15. As shown most clearly in FIG. 1, the DIN connector 20 comprises a housing 22 which is unitarily molded from a nonconductive plastic material. The housing 22 comprises a plurality of through apertures for receiving the pin-receiving contact portions of electrically conductive terminals 24, and a corresponding plurality of channels for receiving the solder tails 25 of the terminals 24. The terminals 24 and the terminal receiving structures on the housing 22 are described and illustrated in detail below. It is to be understood that not all of the terminals 24 are depicted in FIG. 1. It also is to be understood that the respective solder tails 25 will be of different respective configurations.

The housing 22 also is constructed to receive a generally annular conductive internal shield 26 which is dimensioned to substantially surround the pin-receiving contact portions of the terminals 24 and provide appropriate EMI shielding at the interface between the terminals 24 of the miniature circular DIN connector 20 and the corresponding pin terminals of a mateable DIN plug (not shown). The annular internal shield 26 is provided with a ground contact 28 which permits the internal shield 26 to be grounded to a circuit board (not shown) on which the subject DIN connector 20 is mountable.

The housing 22 is lockingly engageable with a base 30 which is unitarily molded from a nonconductive plastic material which preferably, but not necessarily, is the same material from which the housing 22 is molded. As explained and illustrated further below, the base 30 comprises an array of apertures extending therethrough for receiving and positively positioning the solder tails 25 of the terminals 24 through mounting apertures in the circuit board.

The miniature DIN connector 20 further comprises a conductive external shield 32 which surrounds four external sides of the assembled housing 22 and base 30 to provide further EMI shielding, and in particular shielding from EMI generated by the electrical component to which the miniature circular DIN connector 20 is mounted. The external shield 32 comprises a contact 33 which permits the shield 32 to be grounded to the board. The internal shield 26 and the external shield 32 are not electrically or mechanically connected to one another. Rather, the internal and external shields 26 and 32 are separated by the housing 22 and base 30 to perform separate but supplementary shielding functions with separate grounds to the board.

Figure 2:
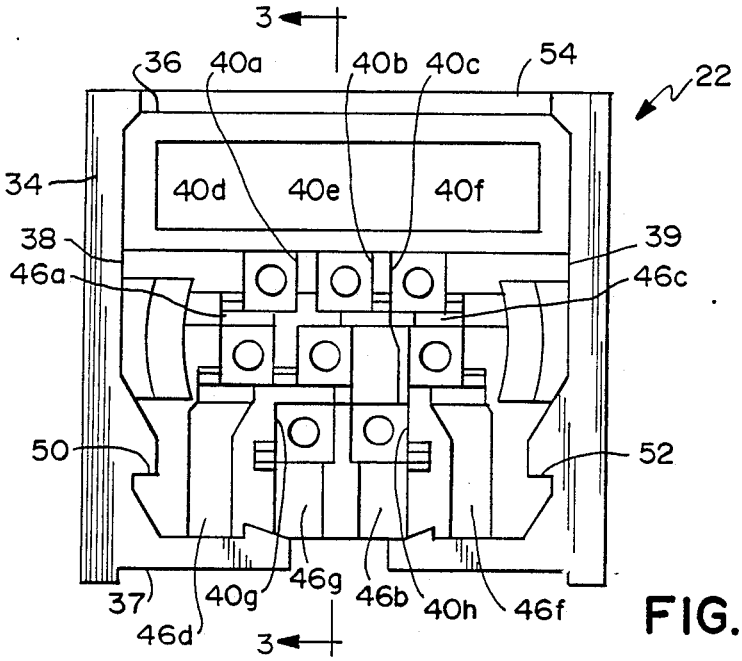
FIG. 2 is a rear elevational view of the housing of the subject DIN connector.
Figure 3:
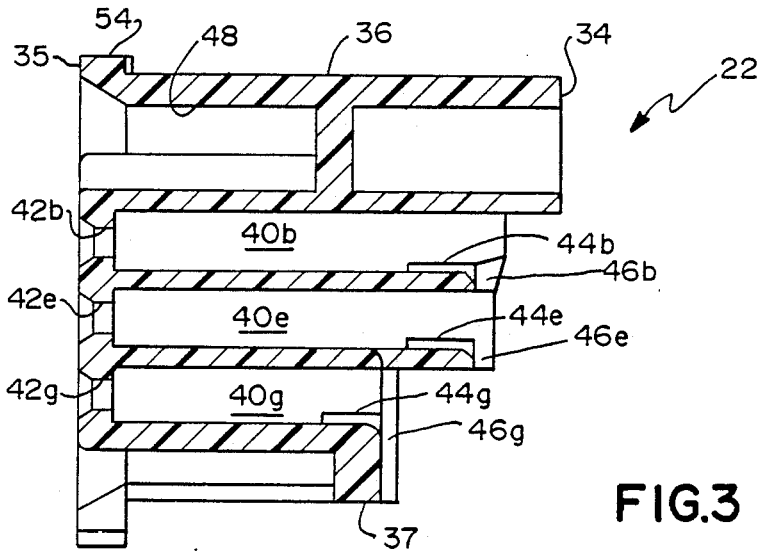
FIG. 3 is a cross-sectional view taken along line 3—3 in FIG. 2.

The housing 22 is shown in greater detail in FIGS. 2 and 3. More particularly, the housing 22 comprises a rear terminal mounting face 34, a front mating face 35, a top 36, a bottom 37 and opposed sides 38 and 39. A plurality of terminal mounting apertures 40*a–h* extend entirely through the housing 22 from the rear face 34 thereof to the front mating face 35. Each mounting aperture 40*a–h* intersects the front mating face 35 of the housing 22 at a substantially circular mating aperture 42*a–h* having a tapered lead-in to facilitate the mating of a DIN plug with the miniature circular DIN connector 20. The rearward portion of the mounting apertures 40*a–h* are depicted in FIG. 2 as being of generally rectangular cross section. The rectangular cross-sectional configuration of the terminal mounting apertures 40 corresponds to the cross-sectional configuration of the terminals as shown in FIG. 1 and in greater detail in FIG. 7. Other configurations and dimensions for the terminal-receiving apertures 40*a–h* may be desired for terminals of other configurations. The apertures 40*a–h* include slots, such as slots 44*b, e* and *g* in FIG. 3 for receiving tabs on the terminals 24 for preventing vertical push-up of the terminals.

The rear face 34 of the housing 22 comprises a plurality of tail-receiving channels 46*a–h* which communicate respectively with the terminal-receiving apertures 40*a–h*. The channels 46*a–h* are dimensioned and located to receive and guide the solder tails 25 extending from the respective terminals 24 mounted in the apertures 40*a–h*. It will be understood that the terminals indicated generally by the numeral 24 will have respective solder tails 25 of dedicated lengths and configurations depending upon the particular channel 46*a–h* for which they are intended. As depicted in FIG. 2, the channels 46*d*, 46*f*, 46*g* and 46*h* may be at a first distance from the rear face 34 of approximately 0.020 inch, while the channels 46*a*, 46*b*, 46*c* and 46*e* may be at a second distance from the rear face 34 of approximately 0.038 inch. Thus, the different positions of the channels 46*a–h* enable the solder tails 25 of the terminals 24 to define two parallel spaced apart rows which may be selectively connected to electrically conductive areas on the printed circuit board. The alignment of the solder tails enabled by the channels 46*a–h* ensures positive positioning and alignment of the solder tails 25 relative to the sides 38 and 39 of the housing 22, thereby enabling the loading of terminals 24 into the housing 22 to be automated, and further enabling the mounting of the housing 22 to the base 30 to be readily automated. With this construction, the slots 44 will engage the tabs on the terminals 24, as explained below, to prevent top-to-bottom movement of the terminals 24 relative to the housing 22, while the channels 46 engage the tails 25 to prevent side-to-side movement.

The housing 22 further comprises a generally annular aperture 48 extending into the front face 35 thereof. The aperture 48 is dimensioned to slidably receive the internal annular shield 26. The opposed sides 38 and 39 of the housing 22 comprises locking ledges 50 and 52 for enabling locking engagement of the housing 22 to the base 30 as explained further below. The housing 22 further comprises a front flange 54 against which the external shield 32 will abut.

Figure 4:
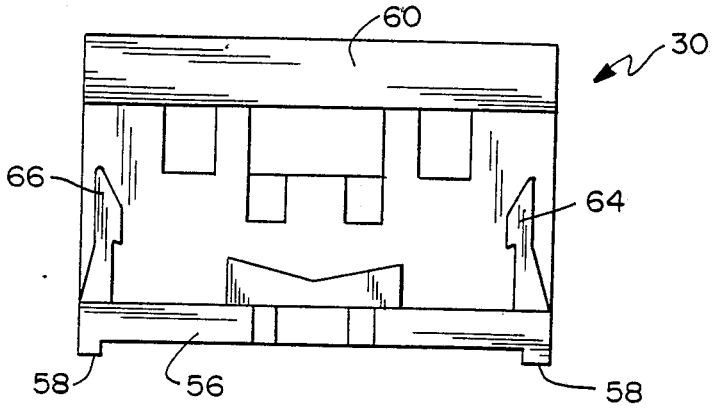
FIG. 4 is a front elevational view of the base of the DIN connector.
Figure 5:
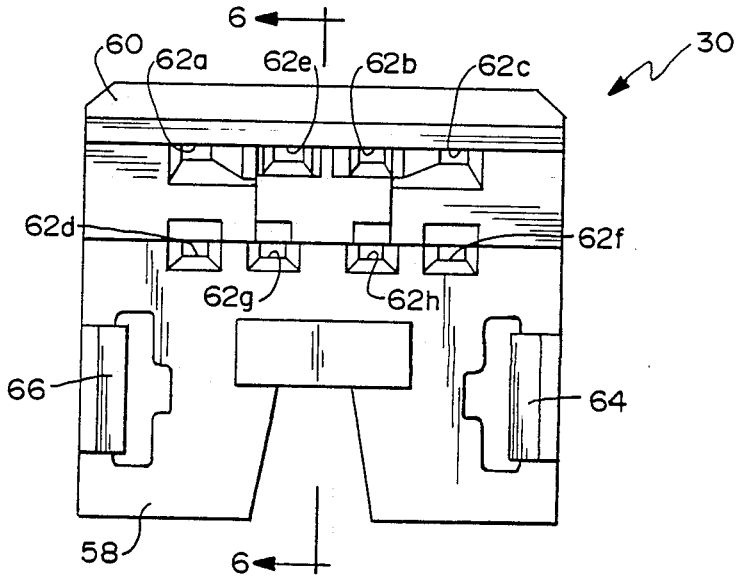
FIG. 5 is a top plan view of the base.
Figure 6:
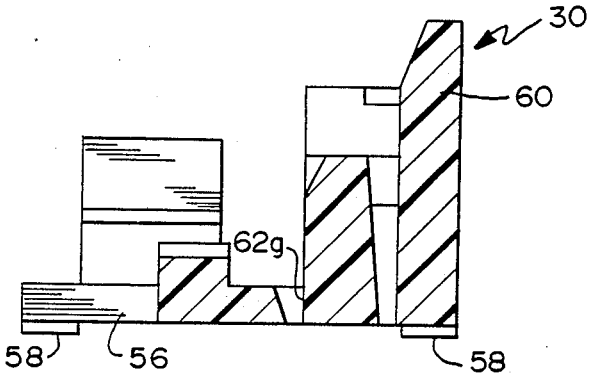
FIG. 6 is a cross-sectional view taken along line 6—6 in FIG. 5.

The base 30 of the miniature circular DIN connector 20 is further illustrated in FIGS. 4–6. More particularly, the base 30 comprises a bottom wall 56 for mounting generally adjacent a printed circuit board, panel or the like. The bottom wall 56 comprises standoffs 58 to enable the major portion of the DIN connector 20 to be in slightly spaced relationship to the corresponding circuit board to permit the washing of flux.

The base 30 further comprises a rear wall 60 which facilitates the guiding of the housing 22 into a proper position, and which functions to insulate and protect the terminals 24 mounted in the housing 22. The rear wall 60 also functions to prevent front-to-rear movement of each terminal 24, thereby keeping each tail 25 in its associated channel 46 of the housing 22. Apertures 62*a–h* extend through the bottom wall 56 of the base 30 adjacent the rear wall 60 for receiving the solder tails 25 of the terminals 24 extending from the channels 46*a–h* in the housing 22. The apertures 62*a–h* each include tapered lead-ins to facilitate the alignment and guiding of the solder tails 25. The alignment of the solder tails 25 with the apertures 62*a–h* is further facilitated by the rear wall 60. The base 30 is further provided with deflectable latches 64 and 66 which are lockingly engageable respectively with the ledges 50 and 52 on the housing 22.

Figure 7:
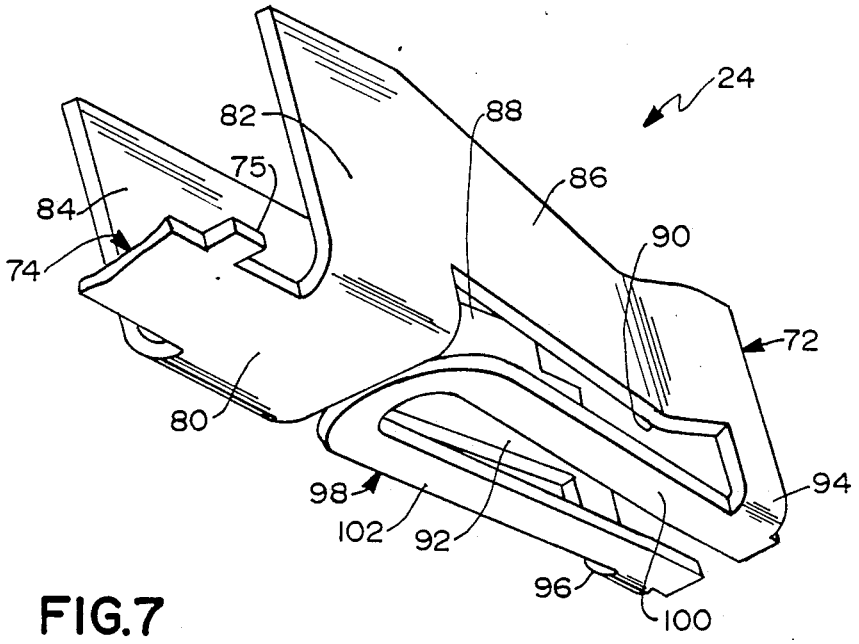
FIG. 7 is a perspective view of the pin contact portion of a terminal for use in the DIN connector.

As noted above, the terminals 24 for mounting in the housing 22 include contact portions substantially as disclosed in co-pending patent application Ser. No. 255,001, the disclosure of which is incorporated herein by reference. Briefly, the contact portion of the terminal 24 is illustrated in FIG. 7 and includes a front end 72 which would be positioned generally adjacent the front face 35 of the housing 22. A rear end 74 is not completely shown in FIG. 6, but would include the right angle solder tail 25 as shown in FIG. 1, and further in FIGS. 11–14 below. The stamped and formed configuration of the solder tails would be selected to follow the configuration of the respective channels 46*a–h* in the housing 22. The rear end 74 further includes a tab 75 which is slidably receivable in the slots 44 of the housing 22 to prevent top-to-bottom movement of the terminal 24 relative to the housing 22.

The terminal 24, as shown in FIG. 7, includes a bight portion 80 and a pair of spaced apart upstanding legs 82 and 84. Cantilevered contact beams 86 and 88 extend forwardly from the legs 82 and 84 respectively toward the front end 72 of the terminal 24. The contact beams 86 and 88 are formed to define spaced apart inwardly directed convex contact surfaces 90 and 92 which are resiliently biased away from one another upon insertion of a pin terminal therebetween. The forward ends of the contact beams 86 and 88 further comprise L-shaped linking members 94 and 96 respectively which extend generally perpendicularly from the cantilevered contact beams 86 and 88 respectively at the front end 72 of the terminal 24. A generally U-shaped resilient beam support 98 extends between and connects the linking members 94 and 96. The U-shaped resilient beam support member 98 includes a pair of arms 100 and 102 which extend unitarily from the linking members 94 and 96 respectively and a bight 104 which unitarily connects the arms 100 and 102. The beam support member 98 is effective to increase the elastic response range of each beam 86, 88 to a greater outer displacement, while providing greater normal contact forces against a pin inserted into the terminal 24. A more detailed description and discussion of the terminal 24 is provided in co-pending application Ser. No. 255,001.

Figure 8:
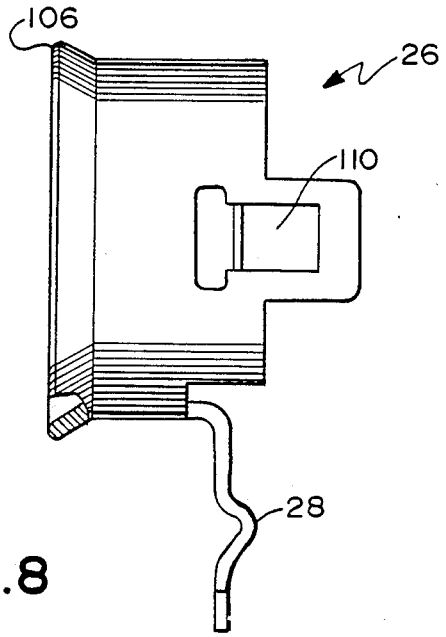
FIG. 8 is a side elevational view of the internal shield for the DIN connector.
Figure 9:
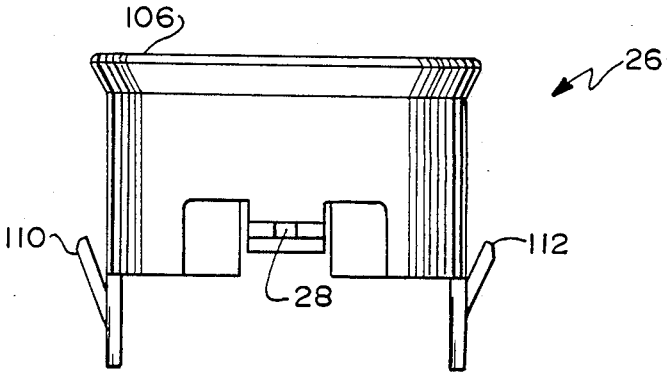
FIG. 9 is a bottom plan view of the internal shield.

The internal shield 26 of the miniature circular DIN connector 20 is shown in greater detail in FIGS. 8 and 9. More particularly, the internal shield 26 comprises an outwardly flared entrance 106 which conforms generally to the configuration of the mounting aperture 48 in the housing 22. The internal shield 26 further includes a contact 28 extending therefrom for mounting to an appropriate ground on the circuit board. The contact 28 is dimensioned to fit through corresponding slots in both the housing 22 and the base 30. As shown most clearly in FIG. 8, the internal shield 26 further comprises locking tangs 110 and 112 extending from opposite sides thereof for locking engagement with corresponding portions of the generally annular aperture 48 in the housing 22 for receiving the internal shield 26.

Figure 10:
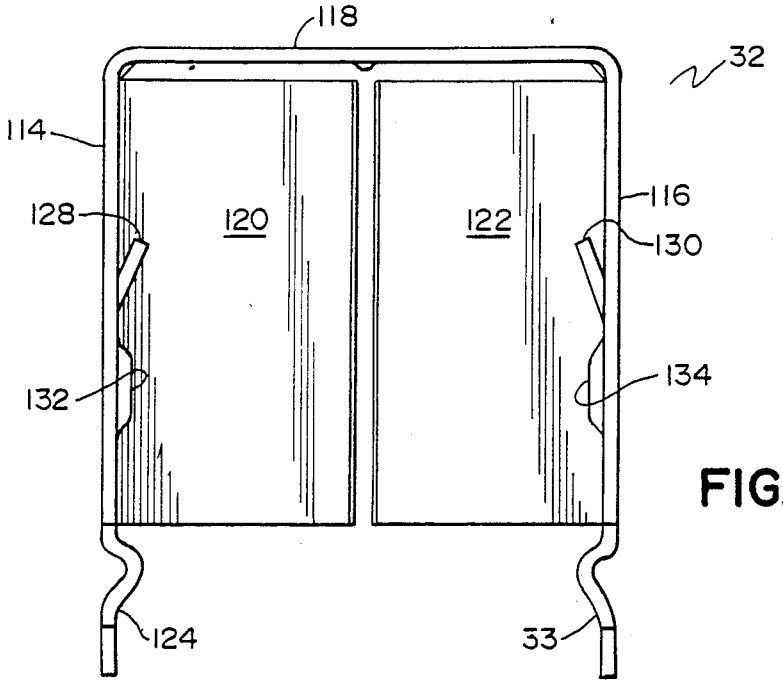
FIG. 10 is a front elevational view of the external shield of the subject DIN connector.
Figure 11:
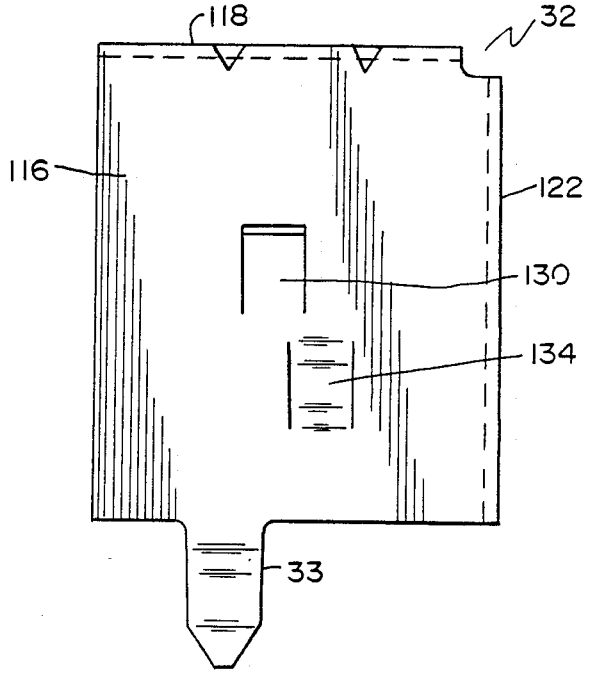
FIG. 11 is a side elevational view of the external shield.

The external shield 32 is depicted in greater detail in FIGS. 10 and 11. In particular, the external shield 32 is formed from a unitary piece of metallic material having a thickness of approximately 0.016 inch. The external shield 32 comprises opposed generally parallel side walls 114 and 116, a top wall 118 extending unitarily between the side walls 114 and 116 and generally perpendicular thereto and opposed coplanar back wall portions 120 and 122 which extend unitarily from the sides walls 114 and 116 respectively and generally orthogonal thereto. The external shield 32 further comprises contacts 124 and 33 which extend respectively from the side walls 114 and 116 to enable grounding of the external shield 32 to the board on which the miniature circular DIN connector 20 is mounted. The external shield 32 also includes locking detents 128–134 which extend from the side walls 114 and 116 as shown in FIGS. 10 and 11 and which are engageable with corresponding portions of the housing 22 to prevent top to bottom and front to rear movement of the external shield 32 relative to the housing 22 as explained below.

Figure 12:
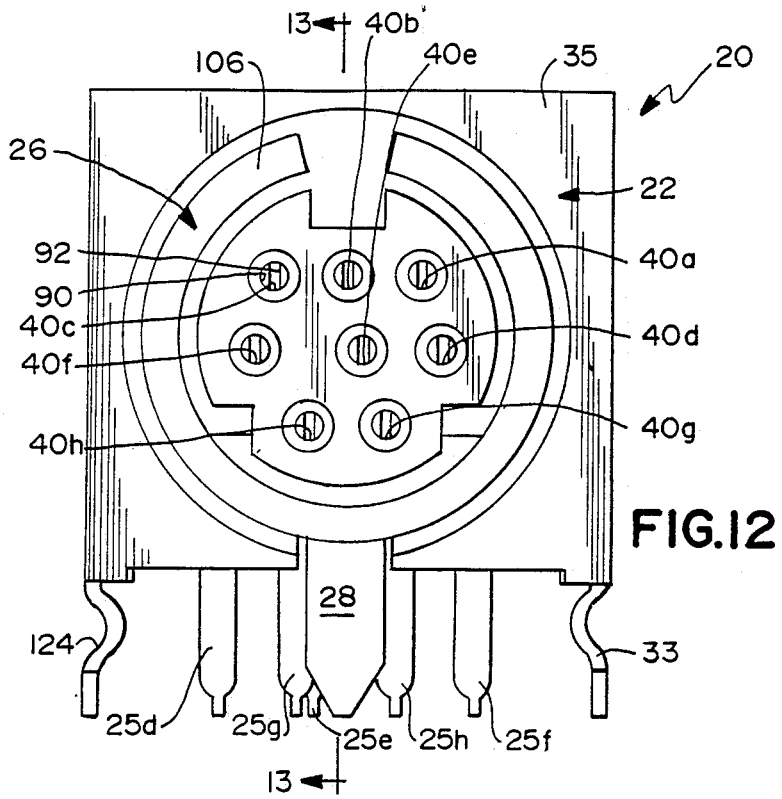
FIG. 12 is a front elevational view of the assembled DIN connector.
Figure 14:
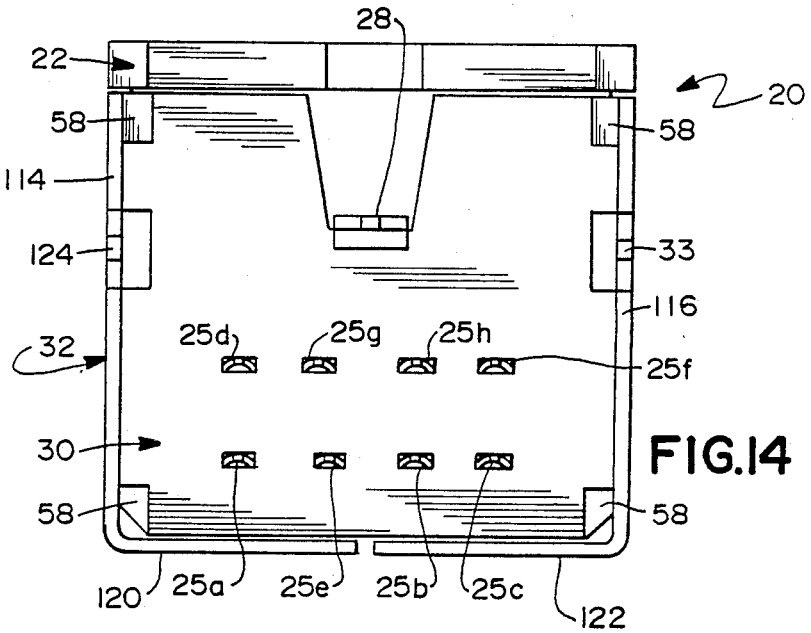
FIG. 14 is a bottom plan view of the assembled DIN connector.
Figure 13:
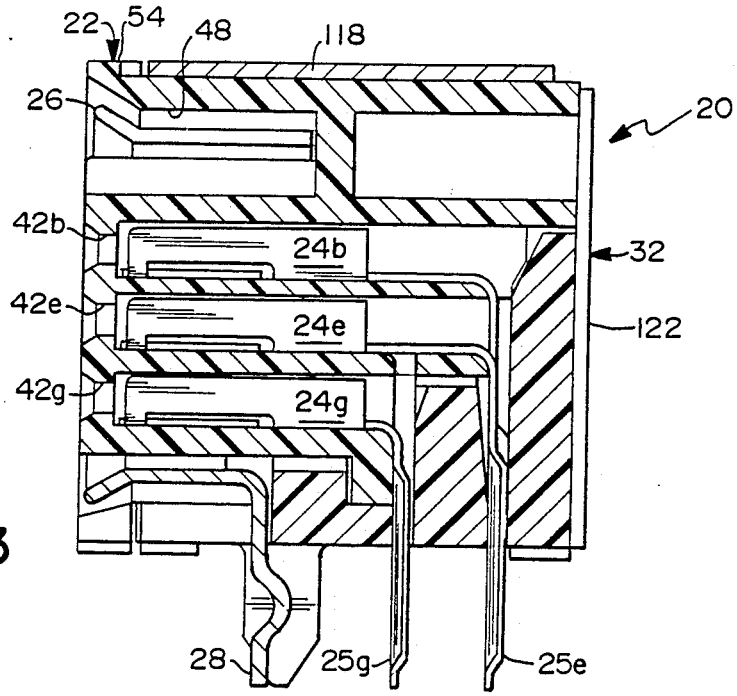
FIG. 13 a cross-sectional view taken along line 13—13 in FIG. 12.
Figure 15:
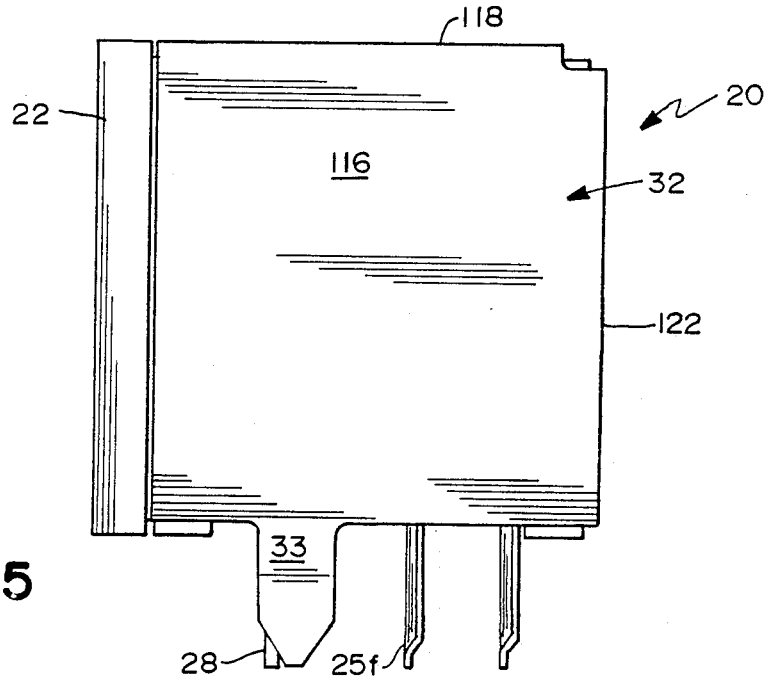
FIG. 15 is a side elevational view of the assembled DIN connector.

The miniature circular DIN connector 20 is shown in exploded form in FIG. 1, and in its assembled form in FIGS. 12–15. The miniature circular DIN connector 20 may be assembled by first inserting the terminals 24*a–h* into the apertures 40*a–h* respectively in the housing 22. The solder tails 25*a–h* on the respective terminals 24*a–h* may be bent prior to insertion into the apertures 40*a–h*, or may alternatively be bent as part of the insertion process. A plurality of the terminals 24*a–h* may be gang loaded with a terminal loading apparatus. The loading of the terminals 24*a–h* into the apertures 40*a–h* is such that the solder tails 25*a–h* thereof are positioned respectively in the channels 46*a–h*. The terminals 24*a–h* further include tabs 75 which are engageable in the tab-receiving slots 44*a–h* of the respective apertures 40*a–h* to prevent relative movement of the terminals 24*a–h* toward or away from the bottom 37 of the housing 22. Thus, each solder tail 25*a–h* is prevented from significant lateral movement by the corresponding channels 46*a–h* and is prevented from movement toward or away from the bottom 37 of the housing 22 by the engagement of the tabs in the corresponding slots 41 of the apertures 40*a–h* respectively. As shown in FIGS. 12 and 13, the opposed convex contact surfaces 90 and 92 of terminals 24*a–h* are in general alignment with the apertures 42*a–h* in the housing for receiving the pin terminals of a DIN plug (not shown) mated with the connector 20.

The assembly of the miniature circular DIN connector 20 may proceed by urging the annular internal shield 26 into the annular aperture 48 of the housing 22; however, the internal shield 26 may be mounted as the last step of the assembly of miniature circular DIN connector 20. The subassembly comprising the housing 22, the terminals 24*a–h* and the internal shield 26 may be mounted to the base 30 such that the solder tails 25*a–h* of the terminals 24*a–h* respectively are inserted into the corresponding apertures 62*a–h* of the base 30. Proper alignment of the solder tails 25*a–h* relative to the apertures 62*a–h* in the base 30 is achieved by both the flared lead-ins to the apertures 62*a–h* and by the guiding function carried out by the rear wall 60 of the base 30. The solder tails 25*a–h* are retained laterally stationary relative to the housing 22 by the respective channels 46*a–h*, thereby ensuring accurate mounting to the base 30. The movement of the housing 22 toward the base 30 causes the latches 64 and 66 to be deflected away from one another. Upon complete seating of the base 22 in the housing 30, the latches 64 and 66 will resiliently return to their unbiased condition and engage the locking ledges 50 and 52 respectively of the housing 22.

The external shield 32 is engaged over the assembled housing 22 and base 30 which separate the internal and external shields 26 and 32 from one another. More particularly, the side walls 114 and 116 of the external shield 32 will generally abut the sides 38 and 39 of the housing 22 and corresponding sides of the base 30. The top wall 118 of the external shield 32 will engage the top 36 of the housing 22, while the rear walls 120 and 122 of the external shield 32 will engage and enclose the rear wall 60 of the base 30. The external . shield 32 extends beyond the bottom wall 56 of the base 30 and generally to the standoffs 58 thereof. Thus, the external shield 32 will approximately abut the board to which the miniature circular DIN connector 20 is mounted along three sides of the DIN connector 20. Top to bottom retention of the external shield 32 on the housing 22 will be achieved by detents 128 and 130 engaging corresponding recesses in the housing 22. Similarly, front to back movement of the external shield 32 relative to the housing 22 and base 30 is achieved by the detents 132 and 134 respectively.

The assembled miniature circular DIN connector 20 can be mounted to a circuit board (not shown) such that the positively positioned solder tails 25*a–h* are inserted through corresponding apertures in the circuit board and are electrically connected to specified conductive portions of the circuit board. The contact 108 extending from the internal shield 26 is appropriately grounded to the circuit board. Similarly, the contacts 124 and 126 of the external shield 32 are appropriately grounded to the board. However, the internal shield 26 and the external shield 32 are not electrically connected to one another. Thus, separate shielding is achieved with assurance that neither the internal shield 26 nor the external shield 32 will function as an antenna.

In many situations the most effective EMI suppression can be attained by providing a direct connection between the external shield 32 and the shield of a DIN connector plug (not shown) which is mated with the miniature circular DIN connector 20. It has also been found that the most effective EMI suppression often can be achieved by maximizing the surface area of the external shield and providing a minimum path direct connection between the external shield and the shield of the mateable DIN connector plug. The above described embodiment is effective in providing a substantially maximum external surface area for the external shield 32 while simultaneously achieving minimum overall dimensions for the miniature circular DIN connector 20. However, the preceding embodiments do not specifically disclose the direct connection between the external shield 32 and the shield of a mateable DIN connector plug. Effective versions of this direct minimum path connection between the external shield 20 and the shield of a mateable DIN connector plug are described in the following paragraphs and are illustrated in FIGS.

16–21. The construction of the embodiments set forth in FIGS. 16–21 can best be appreciated by initially referring to FIG. 1 above. In particular, with reference to FIG. 1, it will be noted that the annular internal shield 26 shown therein is provided with a longitudinally extending slot 27 at generally the top portion of the internal shield 26. The slot 27 can comprise up to about one third the circumference of the internal shield 26. It will also be noted that in the embodiment depicted in FIG. 1 the top 36 of the housing 22 is substantially continuous, and the top wall 118 of the external shield 32 also is substantially continuous and planar. The embodiments of the invention depicted in FIGS. 16–21 comprise the annular external shield 26 as illustrated in FIG. 1 with the longitudinally extending slot 27 adjacent the top thereof. However, the tops of the respective housings depicted in FIGS. 16–21 and the respective external shields of FIGS. 16–21 differ from those described above.

Figure 16:
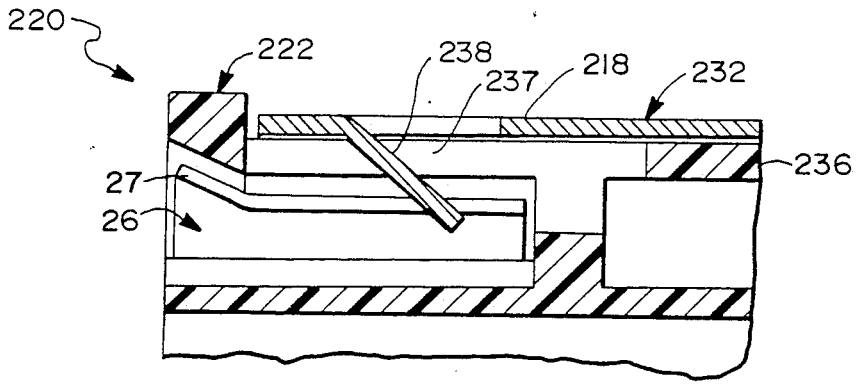
FIG. 16 is a partial cross-sectional view similar to FIG. 13 but showing alternate external and internal shields.

With reference to FIG. 16, a miniature circular DIN connector 220 is depicted with a housing 222 having a top wall 236. The top wall 236 is provided with a centrally disposed aperture 237 substantially aligned with the slot 27 in the internal shield 26. The miniature circular DIN connector 220 of FIG. 16 further comprises an external shield 232 having a top wall 218. The top wall 218 is stamped and formed to define a deflectable contact 238 which extends through the aperture 237 in the housing 222 and through the slot 27 in the internal shield 26. The length and angular alignment of the deflectable contact 238 is selected to ensure that the contact 238 provides a direct minimum path connection between the external shield 232 and the shield of a DIN connector plug (not shown) mated with the miniature circular DIN connector 220.

Figure 17:
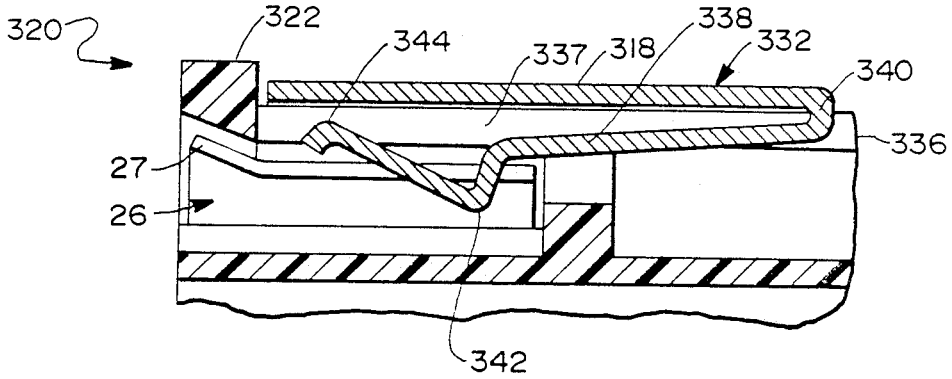
FIG. 17 is a cross-sectional view similar to FIG. 16 but showing a second alternate construction of the shield.

FIG. 17 shows another alternate miniature circular DIN connector identified generally by the numeral 320. The DIN connector 320 includes a molded housing 322 having a top wall 336 with an aperture or slot 337 formed therein. The aperture or slot 337 formed in the housing 322 is longer than the comparable aperture 237 depicted in FIG. 16 above. The DIN connector 320 further comprises an external shield 332 with a top wall 318 having a deflectable contact 338 cantilevered from a rearward location 340 on the external shield 332, and toward the front of the external shield 332. The forward portion of the deflectable contact 338 is bent into the slot 27 of the annular internal shield 26 to define a contact surface 342 which will engage the shield of the DIN connector plug mated with the miniature circular DIN connector 320. The bent configuration of the contact surface 342 of the deflectable contact 338 is intended to assure a smooth entry of the DIN connector plug into the miniature circular DIN connector 320. The FIG. 17 configuration can achieve a higher contact force than the FIG. 16 configuration and further provides a greater external shielding surface. In particular, the initial deflection of the contact 338 will urge the end 344 of the contact beam 338 into contact with the top wall 318 of the external shield 332. Further insertion of the DIN connector plug will require some deflection substantially about the contact point 342, thereby achieving the high normal contact force. This interaction between the deflectable contact 338 and the shield of the mateable DIN connector plug will effectively and desirably increase the force required for disconnection or unmating. It will be appreciated that this construction also achieves a substantially minimal path length between the external shield 332 and the shield of the DIN connector plug, with the minimum path length being defined between contact surfaces 342 and 344 of the deflectable contact 338.

Figure 18:
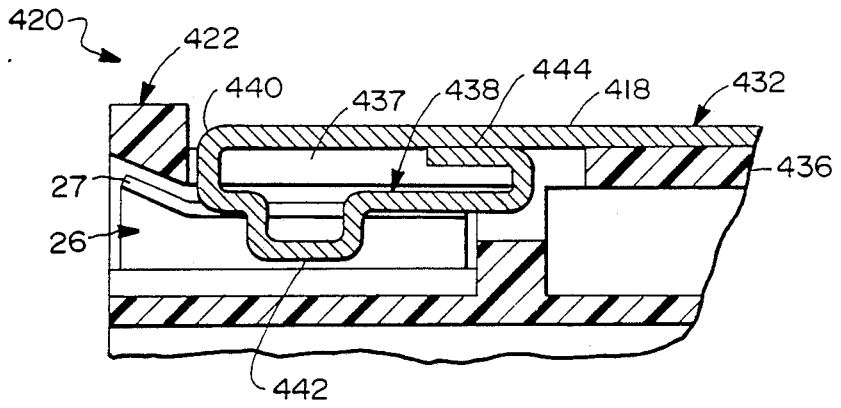
FIG. 18 is a cross-sectional view similar to FIGS. 16 and 17 but showing a third alternate construction for the shields.

The miniature circular DIN connector 420 shown in FIG. 18 includes a housing 422 similar to the housings depicted in FIGS. 16 and 17. More particularly, the housing 422 includes a top wall 436 having an aperture 437 formed centrally therein. The external shield 432 includes a top wall 418 having a contact 438 extending unitarily from the front 440 of the external shield 432. The contact 438 is disposed to extend into the slot 27 formed in the annular internal shield 26 for directly contacting the shield of the mateable DIN connector plug (not shown). The deflectable contact 438 is formed to define a plug contact surface 442 and a shield contact surface 444. For the reasons explained in the preceding paragraph, high contact forces can be developed between the deflectable contact 438 and the shield of the mateable DIN connector plug. These high contact forces can achieve the desirable effect of increasing the forces required for unmating. Additionally, the construction of the contact 438 depicted in FIG. 18 achieves a substantially minimal path length between the external shield 432 and the shield of the DIN connector plug.

Figure 19:
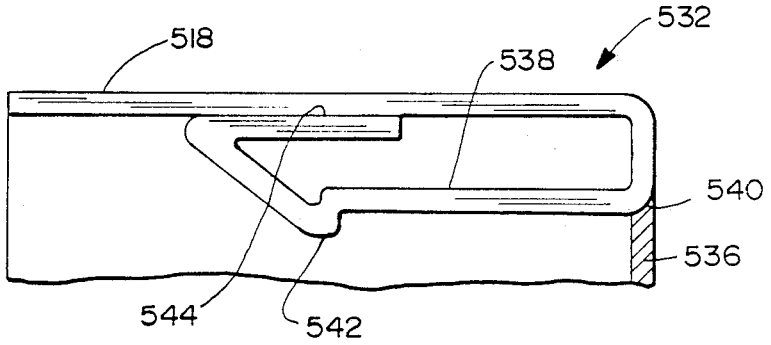
FIG. 19 is a cross-sectional view of a fourth alternate construction for an external shield.
Figure 20:
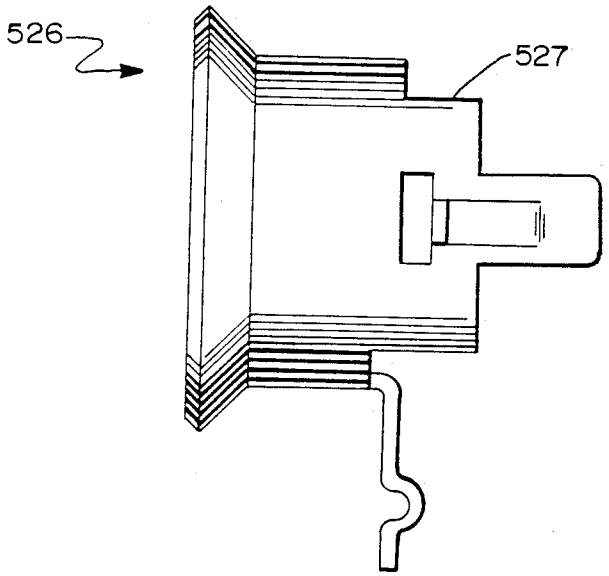
FIG. 20 is a side elevational view of an annular internal shield for use with the external shield depicted in FIG. 19.

FIGS. 19 and 20 show still a further embodiment for achieving direct connection between the external shield and the shield of the mateable DIN connector plug. In particular, FIG. 19 shows an external shield 532 having a top wall 534 and a rear wall 536. A deflectable contact 538 is cantilevered from location 540 on the rear wall 536 and extends forwardly to a contact surface 542 for engaging the shield of the DIN connector plug. The contact 538 is formed to define a second contact surface 544 for contacting the top wall 518 of the external shield 532. As with the previously described embodiments, the deflectable contact 538 will achieve high contact forces against the DIN connector plug and will achieve a minimum path length between the top wall 534 of the external shield 532 and the shield of the DIN connector plug. It will be appreciated that the shield of the DIN connector plug can be appropriately deformed by a dimple, or the like, to define means for engaging the contact surface 542 for further increasing the required disengagement force for unmating a DIN connector plug from the miniature circular DIN connector employing the external shield 532. To incorporate the external shield 532, the housing of the miniature circular DIN connector will require a slot in the top wall extending from the rear of the housing. Additionally, an annular internal shield 526, as depicted in FIG. 20, may be required with an enlarged slot 527 at least adjacent the rearward portions thereof. The slot 527 at the rear of the annular internal shield 526 will be dimensioned to permit the deflectable contact 538 to pass directly into contact with the shield of a mateable DIN connector plug.

Figure 21:
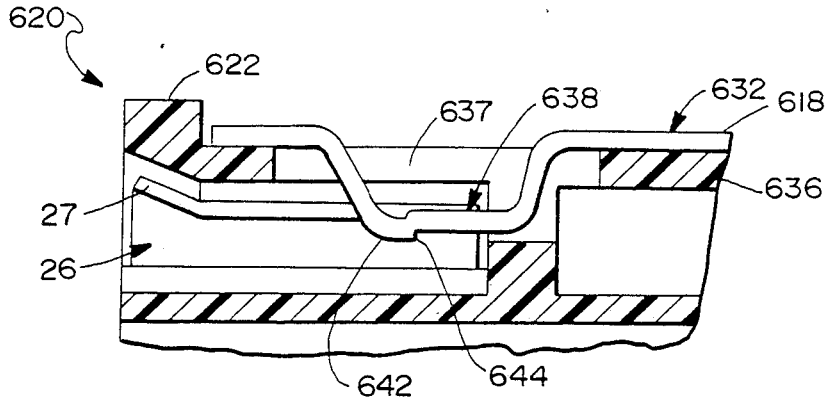
FIG. 21 is a cross-sectional view similar to the views shown in FIGS. 16–18 but showing a fifth alternate embodiment of the external shield with means on the external shield for engaging the shield of a DIN connector plug.

FIG. 21 shows still a further embodiment of the miniature circular DIN connector identified generally by the numeral 620. In particular, the housing 622 of the DIN connector 620 comprises a top wall 636 having an aperture 637 which is centrally disposed and spaced from both the front and rear of the housing 622. The external shield 632 includes a top wall 618 having a central portion which is deformed to define a deflectable contact 638 which extends through the aperture 637 and through the slot 27 in the annular internal shield 26. The deflectable contact 638 defines a contact surface 642 for engaging the shield of a mateable DIN connector plug. The contact surface 642 may be defined by an engaging surface 644 for engaging corresponding structure on the mateable DIN connector plug to increase the disengagement force required for unmating. It will be appreciated that the embodiment of the external shield 636 depicted in FIG. 21 provides a substantially minimum path between the external shield 636 and the mateable DIN connector plug. Additionally, the deflectable contact 638 is formed without discontinuities in the external shield 632, thereby maintaining a substantially maximum surface area for the external shield 632.

Figure 22:
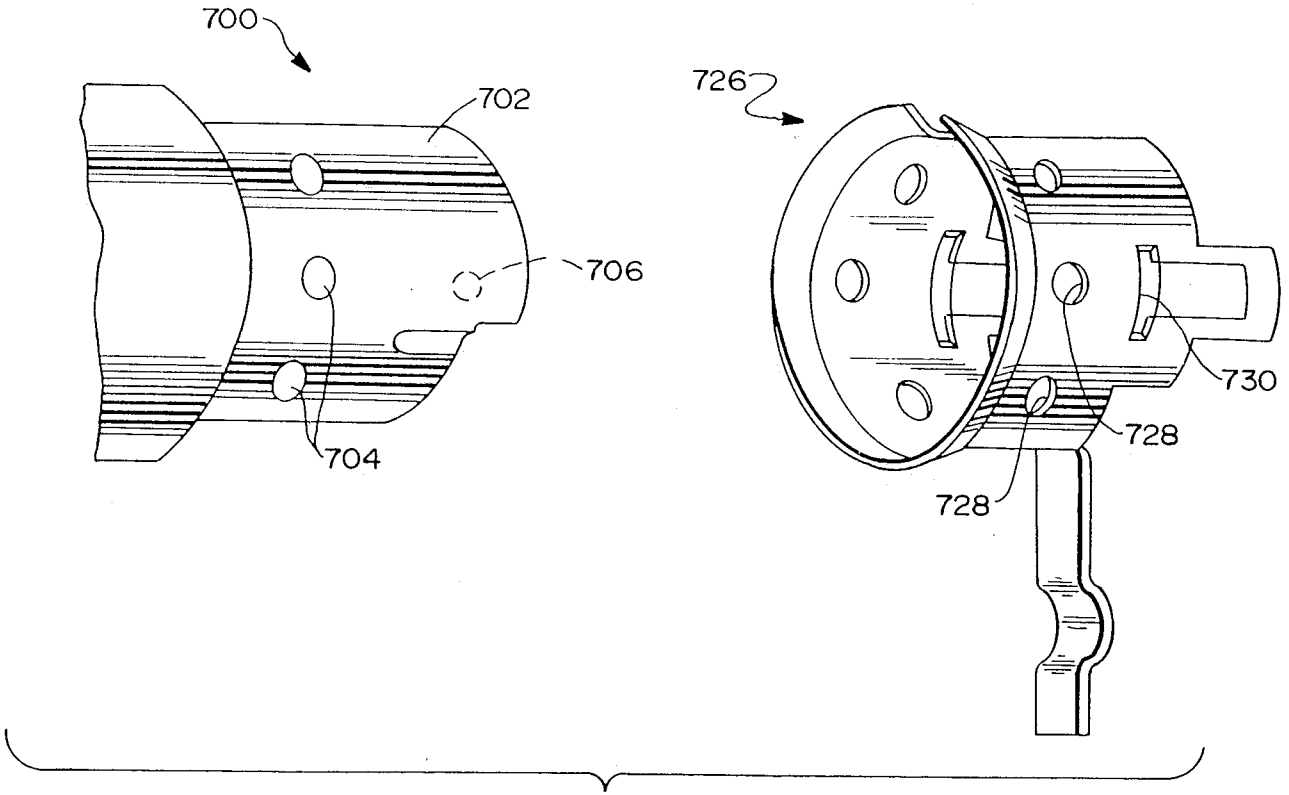
FIG. 22 is an exploded perspective view of an internal annular shield as depicted in FIGS. 16–18 and a mateable DIN connector plug with means for enhancing interengagement forces.

As noted above, it is often desirable to increase the forces required for unmating to more positively prevent unintentional disengagement of the DIN connector plug from the miniature circular DIN connector described and illustrated above. Certain embodiments of the direct connection between the external shield of the miniature circular DIN connector and the mateable DIN connector plug can increase the forces required for unmating. In alternate embodiments or variations of the above described embodiments, the mateable surfaces of the shield on the DIN connector plug and the annular internal shield of the miniature circular DIN connector can be appropriately configured to increase the forces required for unmating. In particular, FIG. 22 shows a DIN connector plug 700 having a generally annular shield 702. The annular shield 702 is characterized by outwardly extending pimples 704 formed therein. The DIN connector plug is mateable with a corresponding miniature circular DIN connector as described and illustrated above. However, the mateable miniature circular DIN connector comprises an annular internal shield 726 having apertures 728 disposed and dimensioned to engage the pimples 704 on the DIN connector plug 700. The engagement of the pimples 704 with the apertures 728 will require increased unmating forces which will substantially prevent accidental unmating. Alternatively, the DIN connector plug could be provided with a pimple 706 disposed and dimensioned to engage the slots 730 which are formed in the annular internal shield 726. The slots 730 are stamped during the formation of locking means for lockingly mounting the internal shield 726 in its housing (not shown).

In summary, a miniature circular DIN connector is provided including a housing having apertures for positively receiving and retaining electrical terminals therein. The housing is lockingly engageable with a base, which in turn is mountable to a circuit board. An internal shield is mountable in the housing to substantially surround the terminals therein, and is grounded to the circuit board. An external shield surrounds four sides of the assembled DIN connector and is separately grounded to the circuit board, or to different locations on common ground. The external shield is directly connectable to the shield of a mateable DIN connector plug. The connection of the external shield to the DIN connector plug may be achieved through slots or apertures in the housing and the internal shield of the miniature circular DIN connector.

While the invention has been described with respect to a preferred embodiment, it is apparent that various changes can be made without departing from the scope of the invention as defined by the appended claims. For example, the miniature circular DIN connector can be manufactured with various different numbers of terminals mounted therein. The terminals illustrated and described above are extremely effective, but advantages of the miniature circular DIN connector can be achieved with other terminal designs. The contact extending between the external shield of the miniature circular DIN connector and the shield of the mateable DIN connector plug may take forms other than those illustrated herein in certain embodiments of the invention.

I claim:

1. A miniature DIN connector for mating with a DIN connector plug having a conductive shield extending thereabout, said miniature DIN connector comprising:

a nonconductive housing having opposed front and rear ends, a top and a bottom, a plurality of terminal-receiving apertures extending between the front and rear ends of said housing, said housing comprising channels generally adjacent the rear thereof and extending from each of said terminal-receiving apertures to the bottom of said housing for positively positioning and retaining portions of terminals extending from the apertures in the housing to a circuit board, said housing further comprising an internal shield aperture extending into the front end thereof and generally around said terminal-receiving apertures, said housing comprising an external shield aperture extending therethrough and into the internal shield aperture;

a plurality of electrically conductive terminals having pin-receiving contact portions engaged in the terminal-receiving apertures of said housing and board contact portions positively retained in the channels of said housing and extending beyond the bottom of said housing;

an internal shield mounted in the internal shield aperture extending into the front end of said housing, said internal shield comprising contact means extending therefrom for electrical connection to a ground and comprising a slot generally aligned with the external shield aperture;

a base having an array of apertures extending therethrough for receiving the board contact portions of said terminals, said base being mountable to the circuit board and comprising means for lockingly engaging the housing to the base; and an external shield substantially defining at least three external sides of said miniature DIN connector and comprising a first contact means for grounding said external shield, said external shield comprising a second contact means extending through the external shield aperture of the housing and through the slot of the internal shield for directly contacting the shield of the DIN connector plug matable with the miniature DIN connector.

2. A miniature DIN connector as in claim 1 wherein said external shield and said internal shield are electrically and mechanically separate from one another.

3. A miniature DIN connector as in claim 1 wherein said external shield surrounds four external sides of said miniature DIN connector.

4. A miniature DIN connector as in claim 3 wherein said miniature DIN connector defines a receptacle of generally rectalinear configuration and defining a top, a bottom, opposed sides, a back and a front mating end for mating with a DIN connector plug, said external shield substantially surrounding both opposed sides, the top and the back of said DIN connector.

5. A miniature DIN connector as in claim 4 wherein the second contact means of said external shield comprises a deflectable contact arm stamped from the portion of said external shield adjacent the top of said housing and cantilevered therefrom into contact with the shield of the DIN connector plug matable with the miniature DIN connector.

6. A miniature DIN connector as in claim 4 wherein portions of said external shield surrounding the sides, the top and the back of said DIN connector are substantially continuous, and wherein the second contact means of said external shield defines a deflectable contact arm cantilevered from the top of said external shield.

7. A miniature DIN connector as in claim 6 wherein the second contact means of the external shield is cantilevered from a portion of the external shield generally adjacent the front mating end of the connector.

8. A miniature DIN connector as in claim 6 wherein the second contact means of said external shield is cantilevered from a portion of the external shield generally adjacent the back thereof.

9. A miniature DIN connector as in claim 1 wherein the second contact means of the external shield comprises means for engaging the shield of the DIN connector plug for increasing the forces required to unmate the DIN connector plug from the miniature DIN connector.

10. A miniature DIN connector for mounting to a board and for receiving a DIN connector plug having a shield extending thereabout, said miniature DIN connector comprising a housing having a mating face, a board mounting face and a plurality of external faces, said housing comprising a plurality of electrically conductive terminals mounted therein, a metallic internal shield mounted to said housing and substantially surrounding and spaced from the terminals therein, said internal shield comprising contact means for grounding said internal shield to the board, a metallic external shield comprising a plurality of walls for substantially surrounding the external faces of said housing, said external shield further comprising a first contact means for grounding said external shield to the board and a second contact means extending inwardly towards said internal shield for directly contacting the shield of the DIN connector plug matable with said miniature DIN connector, said internal shield and said external shield being electrically separate from one another.

11. A miniature DIN connector as in claim 10 wherein the external shield extends generally into proximity to the board mounting face of said housing, such that said external shield extends generally into abutting relationship with a board to which said DIN connector is mounted.

12. A miniature DIN connector as in claim 10 wherein the internal shield extends from the mating face of said housing and generally orthogonal thereto.

13. A miniature DIN connector as in claim 10 wherein the internal shield comprises a slot extending therethrough and aligned with the second contact means, said second contact means extending through said slot for contacting the shield of the DIN connector plug.

14. A miniature DIN connector as in claim 10 wherein said housing is of generally rectalinear configuration and comprises a top wall extending generally parallel to the base mounting face of said housing, a pair of opposed generally parallel side walls and a back wall extending generally parallel to the mounting face of said housing, an aperture extending into said housing, said external shield generally conforming to the shape of said housing and comprising a top wall, a pair of opposed generally parallel side walls extending generally orthogonally from said top wall and a back wall extending generally orthogonally from said top and side walls, said second contact means extending through the aperture in the housing for contacting the shield of the DIN connector plug matable with the miniature DIN connector.

15. A miniature DIN connector as in claim 14 wherein said second contact means is cantilevered from the top wall of said external shield.

16. A miniature DIN connector as in claim 15 wherein said second contact means is cantilevered from a portion of the top wall generally adjacent the back wall of said external shield.

17. A miniature DIN connector as in claim 15 wherein said second contact means is cantilevered from a portion of the top wall spaced from the back wall of the external shield.

18. A miniature DIN connector as in claim 14 wherein said second contact means is cantilevered from the back wall of said external shield.

19. A miniature DIN connector as in claim 10 wherein said second contact means comprises means for grippingly engaging the shield of the DIN connector plug matable with the miniature DIN connector for increasing the forces required for unmating.

* * * * *